US006938542B1

(12) United States Patent
Ho et al.

(10) Patent No.: US 6,938,542 B1
(45) Date of Patent: Sep. 6, 2005

(54) EMBOSSING TOOL

(76) Inventors: Lee Cheng Ho, 5F, No. 12 Alley 29, Lane 10, Sec. 3, Shiow Laang Rd., Jong Her City, Taipei Hsien (TW); Chen Cheng Nan, No. 12, Lane 122, Sec. 2, Shih Wann Rd., Shih Jyy Jenn, Taipei Hsien (TW)

( * ) Notice: Subject to any disclaimer, the term of this patent is extended or adjusted under 35 U.S.C. 154(b) by 0 days.

(21) Appl. No.: 10/821,644

(22) Filed: Apr. 9, 2004

(51) Int. Cl.[7] ..... B41F 1/07

(52) U.S. Cl. ..... 101/31.1; 101/3.1; D18/15; 400/134.4

(58) Field of Search ..... 101/3.1, 16, 17, 101/28, 29, 31.1, 32; D18/15; 400/134.4

(56) References Cited

U.S. PATENT DOCUMENTS

| | | | | | |
|---|---|---|---|---|---|
| 1,150,179 | A | | 8/1915 | Dom | |
| 1,541,188 | A | | 6/1925 | Salt | |
| 1,692,764 | A | | 11/1928 | Salt | |
| 2,017,195 | A | | 10/1935 | Anderson et al. | 164/91 |
| 2,449,108 | A | | 9/1948 | Carlock | 164/96 |
| 3,073,199 | A | | 1/1963 | Yerkes | 83/549 |
| 3,368,441 | A | | 2/1968 | Piazze | 83/588 |
| 3,385,152 | A | | 5/1968 | Brown et al. | 83/633 |
| 3,459,084 | A | | 8/1969 | Schlafly | 82/213 |
| 3,714,857 | A | | 2/1973 | Stuertz et al. | 83/468 |
| 3,785,233 | A | | 1/1974 | Robinson | 83/167 |
| 4,036,088 | A | | 7/1977 | Ruskin | 83/167 |
| 4,278,017 | A | * | 7/1981 | Conjura | 101/31.1 |
| 4,594,927 | A | | 6/1986 | Mori | 83/620 |
| 4,637,741 | A | | 1/1987 | Gillet | 384/428 |
| 4,713,995 | A | | 12/1987 | Davi | 83/167 |
| 4,753,010 | A | | 6/1988 | Franovich | 30/124 |
| D296,565 | S | * | 7/1988 | Eichenberg et al. | D18/14 |
| 4,757,733 | A | | 7/1988 | Barlow | 83/588 |
| 5,163,350 | A | | 11/1992 | Groswith, III et al. | 83/549 |
| 5,243,887 | A | | 9/1993 | Bonge, Jr. | 83/54 |
| 5,286,129 | A | | 2/1994 | French et al. | 403/24 |
| 5,415,144 | A | * | 5/1995 | Hardin et al. | 123/399 |
| D373,385 | S | | 9/1996 | Birkholz | D19/72 |
| 5,601,006 | A | | 2/1997 | Quinn et al. | 83/588 |
| 5,658,421 | A | | 8/1997 | Carroll | 156/513 |
| 5,697,278 | A | | 12/1997 | Shun-Yi | 83/588 |
| D393,657 | S | | 4/1998 | Bennett | D19/72 |
| 5,749,278 | A | | 5/1998 | Lee et al. | 83/588 |
| 5,778,750 | A | | 7/1998 | Drzewiecki et al. | 83/628 |
| 5,778,774 | A | * | 7/1998 | Lavoie | 101/28 |

(Continued)

*Primary Examiner*—Eugene H. Eickholt
(74) *Attorney, Agent, or Firm*—Sofer & Haroun, LLP

(57) ABSTRACT

An embossing tool for embossing a sheet of material has a body formed with a fissure for receiving the sheet of material, a lever pivotably mounted about a pivot point on the body and a block positionable between the lever and the body. The block has an embossing face moveable along a first axis, and further has a center riser configured to receive the lever. At least one resilient member is provided, adjacent to the embossing face along a second axis, spaced apart from the first axis, and disposed between the block and the body. When the block is positioned between the lever and the body and when the lever is pivoted about the pivot point between a first position and a second position, the lever engages the block having the axially moveable embossing face to emboss the sheet of material.

10 Claims, 6 Drawing Sheets

U.S. PATENT DOCUMENTS 5,819,647 A * 10/1998 Balosh ..... 101/31.1
D406,606 S 3/1999 Lee ..... D19/72
D407,752 S 4/1999 Kim et al. ..... D19/72
D409,630 S 5/1999 Cornell et al. ..... D15/127
6,000,139 A 12/1999 Chan ..... 30/358
D419,178 S * 1/2000 Kim et al. ..... D18/15
6,089,137 A 7/2000 Lee ..... 83/621
6,109,155 A 8/2000 Huang ..... 83/628
D433,062 S 10/2000 Ho ..... D19/72
6,513,413 B2 2/2003 Lee ..... 83/633
RE38,219 E 8/2003 Lee et al. ..... 83/588
D480,103 S * 9/2003 Stefanski et al. ..... D18/15
D482,729 S * 11/2003 Chi Kuo ..... D19/72
6,739,244 B1 * 5/2004 Carbaugh ..... 101/3.1
D491,230 S * 6/2004 Lee ..... D19/72

* cited by examiner

EMBOSSING TOOL

FIELD OF THE INVENTION

The present invention is directed to an embossing tool for embossing craft paper products.

BACKGROUND OF THE INVENTION

The present invention relates to an embossing tool in which a mold block is movably disposed in a seat body. A pressing lever is pivotally disposed on the seat body for pressing the mold block. The seat body is formed with a fissure and the mold block is formed with a die. A paper or a sheet can be pushed into the fissure of the seat body and then the pressing section of the pressing lever is depressed, whereby the mold block is forced downward with an embossing face, embossing the paper or the sheet placed in the fissure. Therefore, many sheets can be embossed with a shape as that of the embossing face.

SUMMARY OF THE INVENTION

It is a primary object of the present invention to provide an embossing tool including a seat body formed with a horizontal fissure and a vertical chamber communicated with the fissure. A mold block is disposed in the chamber. One face of the mold block is disposed with a solid embossing face, while the other face of the mold block is disposed with a channel passing through the mold block. A pressing lever is pivotally disposed in the channel of the mold block. A housing covers the seat body and is formed with a window for a pressing section of the pressing lever to extend there through. In use, a paper or a sheet is pushed into the fissure of the seat body and then the pressing section of the pressing lever is depressed to force the mold block downward with the die embossing the paper or the sheet placed in the fissure. Therefore, the sheet is embossed with a shape of that of the embossing face.

It is a further object of the present invention to provide the above embossing tool in which a resilient member is fitted under the mold block in the chamber of the seat body. After the mold block is released from the pressing force of the pressing lever, the resilient member serves to restore the mold block to its home position.

DETAILED DESCRIPTION OF THE PREFERRED EMBODIMENT

Figure 1:
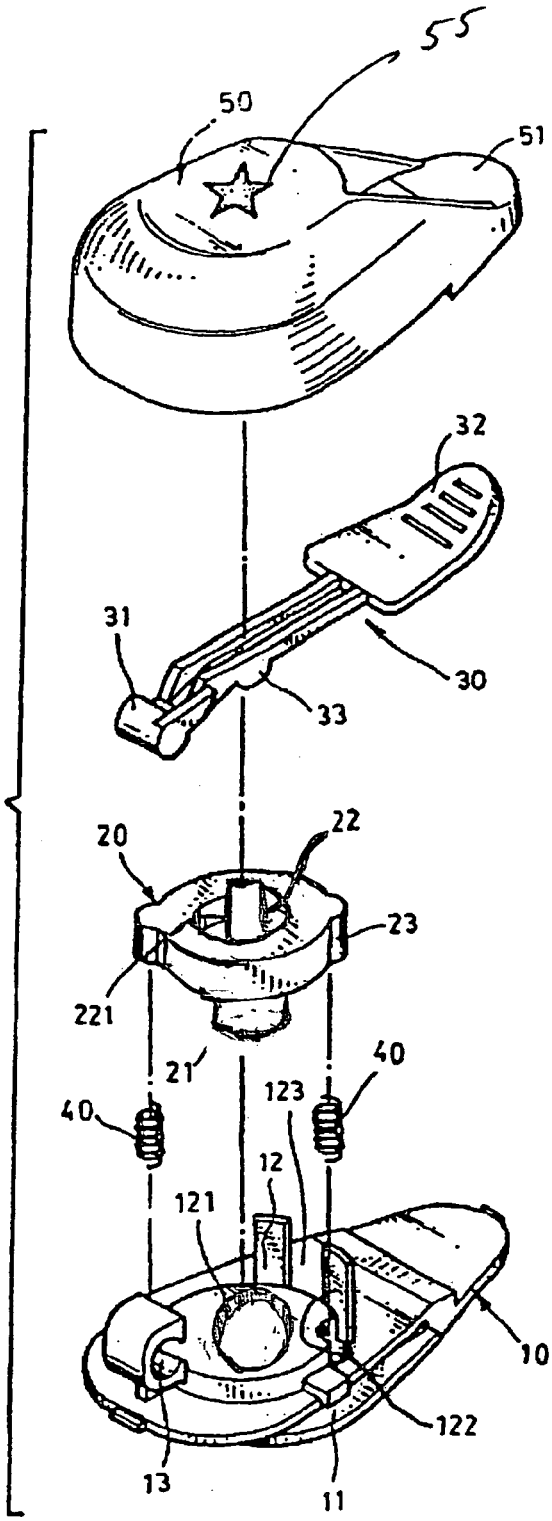
FIG. 1 is a perspective exploded view of an embossing tool in accordance with one embodiment of the present invention.

Please refer to FIGS. 1 to 8. In a first embodiment of the present invention, as illustrated in FIG. 1, the embossing tool includes a seat body 10 formed with a horizontal fissure 11 at one end and a vertical chamber 12. The bottom of the chamber 12 is formed with a circular opening 121 communicated with the fissure 11. An upward extension 122 is disposed on rear side of the chamber 12. A pair of opposite notches 123 is formed on the periphery of the chamber 12. An insertion cavity 13 is disposed in one notch 123 opposite to the other notch 123. The bottom of the seat body 10 is formed with a mating design protrusion 14 communicated with the fissure 11 opposite to the opening 121. Mating design protrusion 14 is in the form of an outline of the shape to be embossed on a desired sheet 60.

A mold block 20 is disposed on the seat body 20. One face of the mold block 20 facing the fissure 11 is disposed with an embossing face 21 such as an animal or a cartoon picture, matching mating design protrusion 14 on seat body 10. Embossing face 21 is in a cutout format that substantially accepts the extending elements of mating design protrusion 14 as is the case with typical corresponding embossing plates.

The other face of the mold block 20 is disposed with a center riser 22 passing through the mold block 20. Recessed rise 221 is formed around center riser 22. The mold block 20 is disposed with a projection 23 corresponding to the extension 122 to be fitted therein.

A pressing lever 30 is disposed in the mold block 20. One end of the pressing lever 30 is disposed with a pivot shaft 31 for rotatably inserting in the insertion cavity 13 of the seat body 10, whereby the pressing lever 30 is pivotally disposed on the seat body 10. The other end of the pressing lever 30 is disposed with an upward bent pressing section 32. In addition, the pressing lever 30 is formed with a protuberance 33 extending in a direction reverse to that of the pressing section 32 for fitting onto center riser 22 of mold block 20.

At least one resilient member 40 is fitted under the projection 23 of the mold block 20. As illustrated in FIG. 1, preferably two resilient members 40 where at least one resilient member 40 comprises first and second oppositely disposed springs adjacent to embossing face 21. The first spring is disposed along a second axis and the second spring disposed along a third axis, the third axis spaced apart from the first embossing face axis and the second axis.

Figure 2:
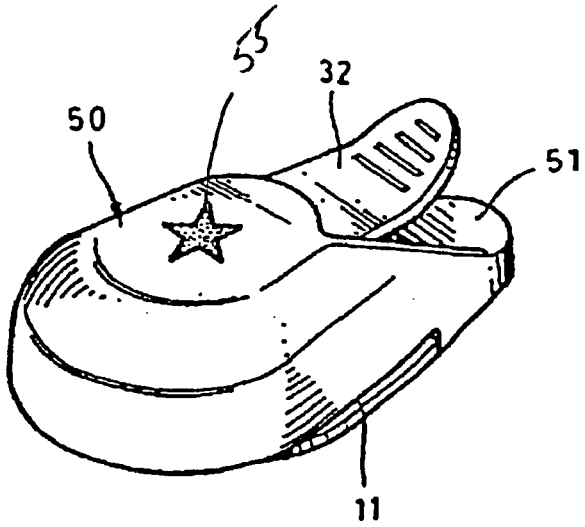
FIG. 2 is a perspective assembled view of the embossing tool from FIG. 1, in accordance with one embodiment of the present invention.
Figure 3:
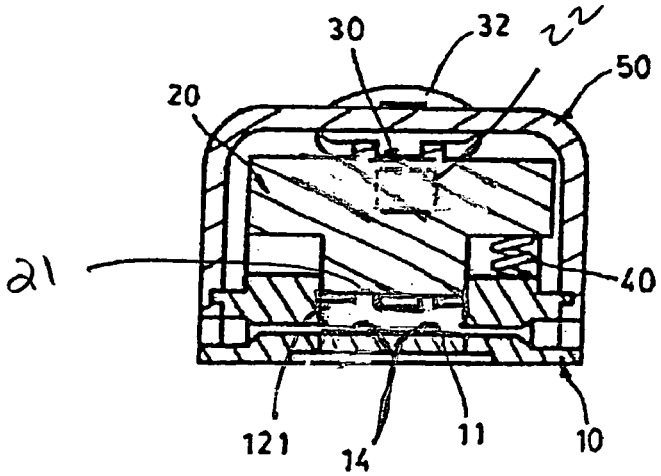
FIG. 3 is a front sectional view of the embossing tool from FIG. 1, in accordance with one embodiment of the present invention.
Figure 4:
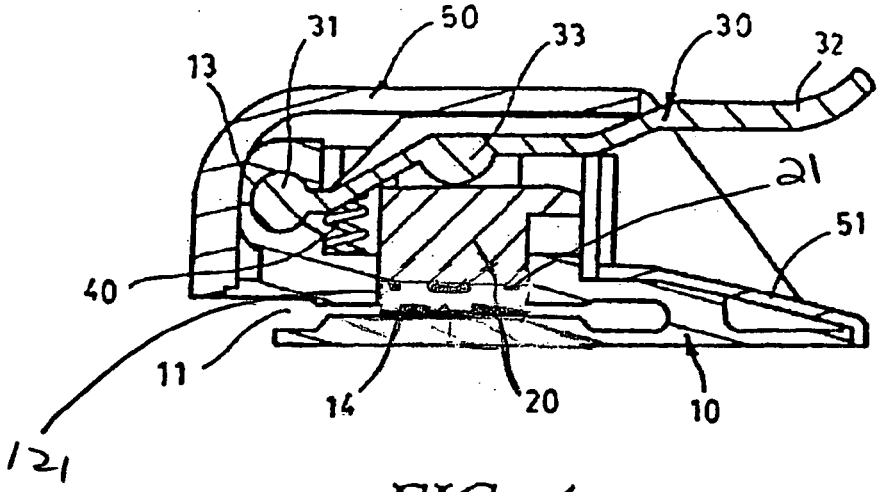
FIG. 4 is a side sectional view of the embossing tool from FIG. 1, in an open position, in accordance with one embodiment of the present invention.

As illustrated in FIG. 2, a housing 50 covers the seat body 10 and is formed with a window 51, whereby the pressing section 32 of the pressing lever 30 can extends through the window 51 out of the housing 50. As illustrated in FIGS. 1 and 2, housing 50 preferably maintains an indication 55 corresponding to the shape of embossing face 21.

Figure 5:
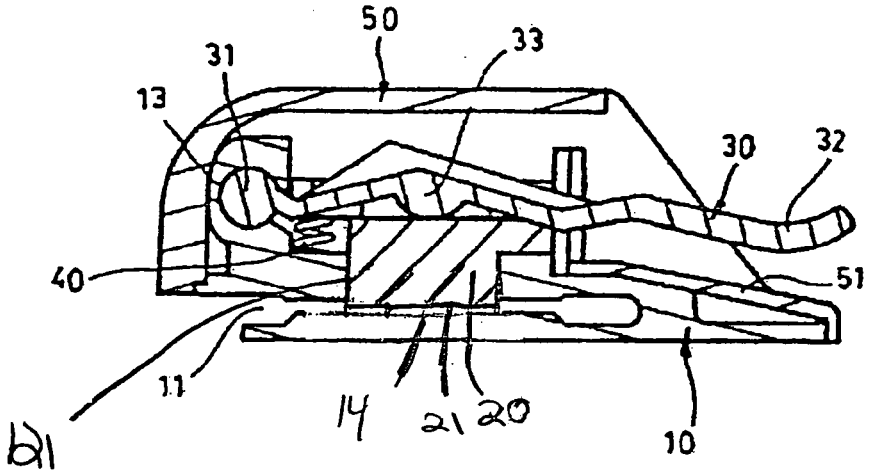
FIG. 5 is a side sectional view of the embossing tool from FIG. 1, in a closed embossing position, in accordance with one embodiment of the present invention.
Figure 6:
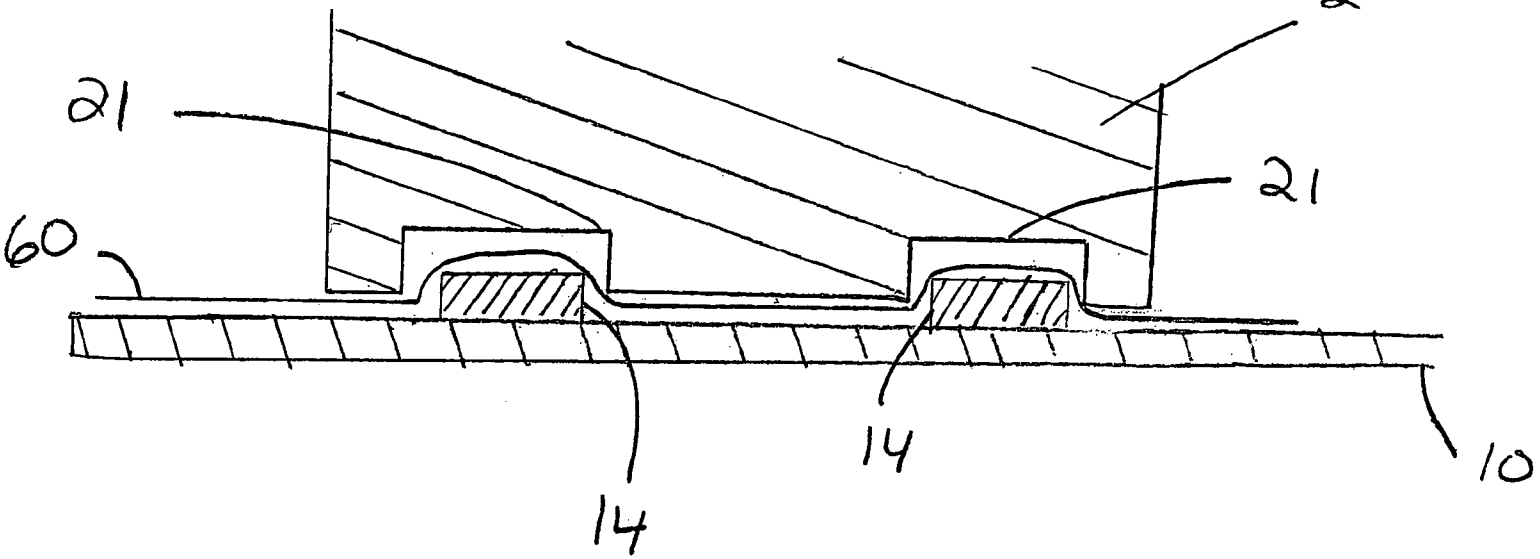
FIG. 6, is a close up side view of sheet being embossed in the embossing tool from FIG. 1, in accordance with one embodiment of the present invention.

In use, as illustrated in FIGS. 3–6, a paper or a sheet 60 is horizontally placed in the fissure 11 of the seat body 10 and pushed inward to a true position over mating design protrusion 14. Fissure 11 is maintained perpendicular to the movement axis of embossing face 21. Then the pressing section 32 of the pressing lever 30 is pivotally depressed about the pivot shaft 13, whereby the protuberance 33 of the pressing lever 30 is moved downward to exert a force onto the mold block 20 as shown in FIG. 5. Accordingly, the mold block 20 is forced downward with embossing face 21 passing through the opening 121, which may maintains a shape corresponding to embossing face 21, of the chamber 12 onto mating design protrusion 14 to emboss the paper or the sheet 60 placed in the fissure 11. A close up view of paper 60, being embossed between embossing face 21 and mating design protrusion 14 is illustrated in FIG. 6. Therefore, sheet 60 is embossed with a shape as that of the embossing face 21 and mating design protrusion 14.

Resilient member(s) 40 serves to restore the mold block 20 to its home position. At this time, the pressing section 32 of the pressing lever 30 is moved upward along with the mold block 21 to its home position. The above operation can be repeatedly performed to emboss many products.

Figure 7:
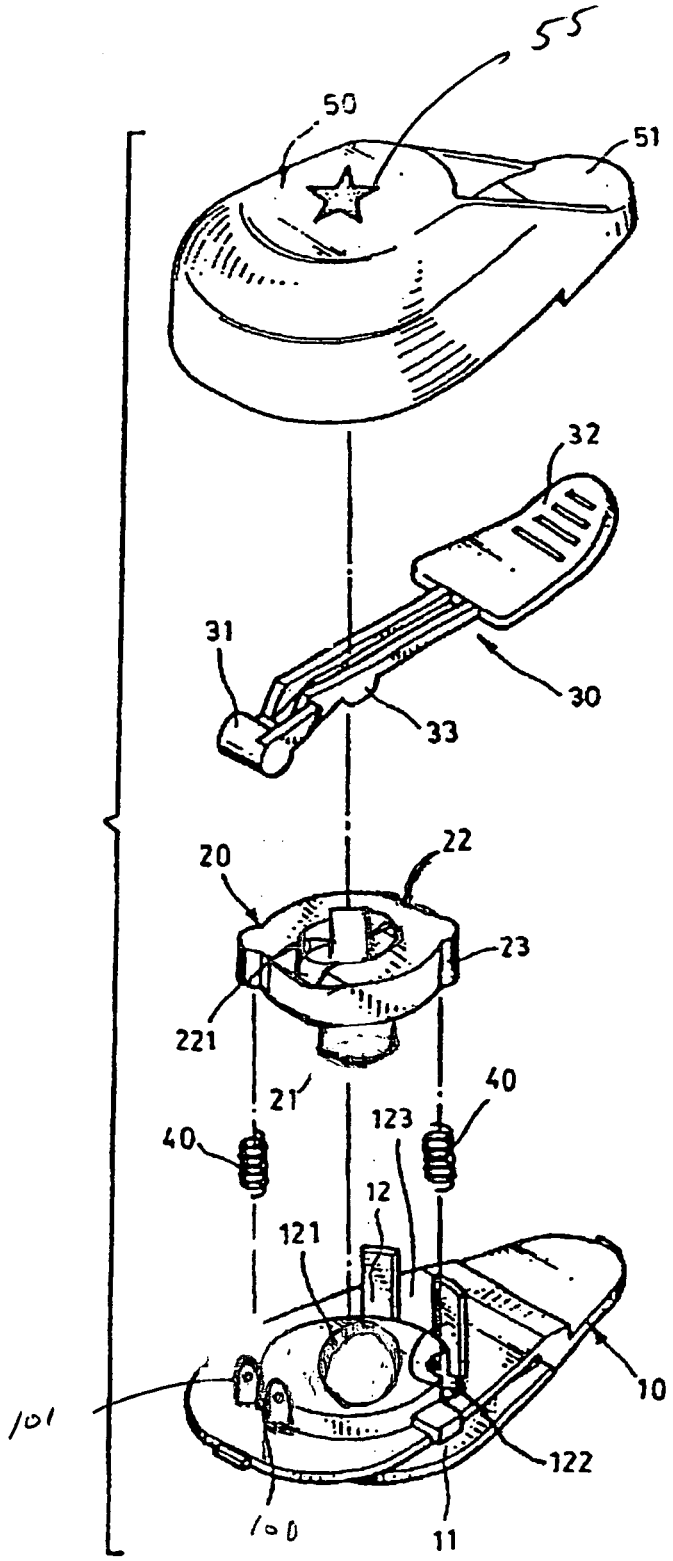
FIG. 7 is a perspective exploded view of an embossing tool according to another embodiment of the present invention.
Figure 8:
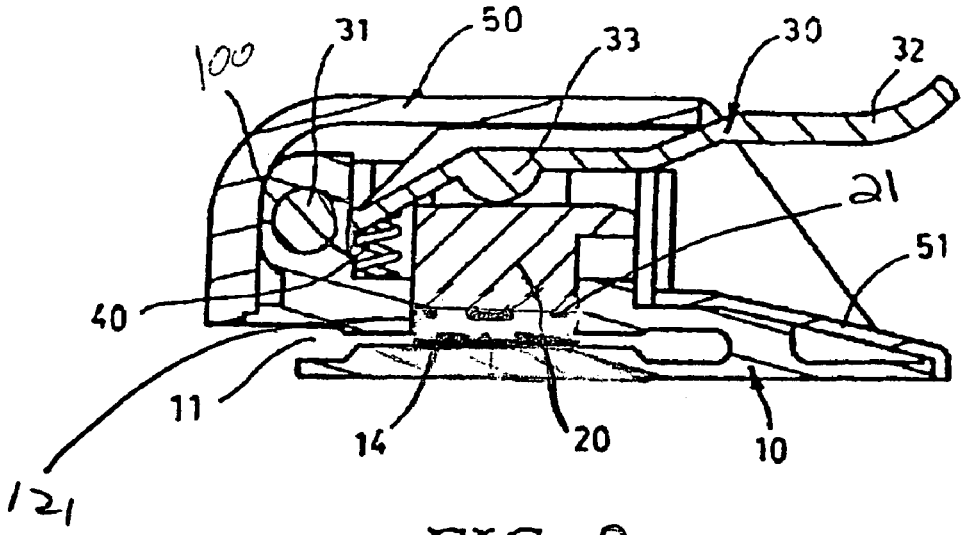
FIG. 8 is a side sectional view of the embossing tool from FIG. 7, in an open position, in accordance with one embodiment of the present invention.

In another embodiment of the present invention as illustrated in FIGS. 7 and 8, the embossing tool pressing level 30 may be attached to seat body 10 in an alternative arrangement. As illustrated in FIGS. 7 and 8 attachment pinions 100 and 101 may be used to support pressing lever 30 in a similar pivoting arrangement to that described above. In this arrangement pivot shaft 31 is fitted on one side into attachment pinion 100 and on the other side to attachment pinion 101, such that when depressed, pressing lever 30 is rotated about an axis through pivot shaft 31 and depresses between pinions 100 and 101.

It is noted that pivot shaft is illustrated as being positioned in the upper inner portion of pinions 100 and 101, however this is in no way intended to limit the scope of the present invention. For example, pivot shaft 31 of pressing level 30 may be removable from pinions 100 and 101 or maybe in a fixed position.

It is to be understood that the above description and drawings are only used for illustrating one embodiment of the present invention, not intended to limit the scope thereof. Any variation and derivation from the above description and drawings should be included in the scope of the present invention.

What is claimed is:

1. An embossing tool for embossing a sheet of material, said embossing tool comprising:

a body formed with a fissure for receiving the sheet of material;

a lever pivotably mounted about a pivot point on said body;

a block positionable between said lever and said body, said block having an embossing face moveable along a first axis, said block further comprising a center riser configured to receive said lever; and at least one resilient member adjacent to said embossing face along a second axis spaced apart from said first axis, and disposed between said block and said body, wherein when said block is positioned between said lever and said body and when said lever is pivoted about said pivot point between a first position and a second position, said lever engages said block having said axially moveable embossing face to emboss the sheet of material.

2. An embossing tool as claimed in claim 1, wherein an outward extension is disposed on rear side of the chamber of the seat body, the mold block being disposed with a projection for fitting in the extension, the resilient member being fitted under the projection between the bottom of the chamber and the mold block.

3. An embossing tool as claimed in claim 1, wherein a housing covers the seat body and is formed with a window, whereby the pressing section of the pressing lever extends through the window out of the housing.

4. An embossing tool as claimed in claim 1, wherein the resilient member is a spring.

5. An embossing tool for embossing a sheet of material, said embossing tool comprising:

a body formed with a fissure for receiving the sheet of material;

first and second pinions defining a pivot axis, said first and second pinions mounted on said body and spaced apart to define an intermediate gap;

a lever having a pivot shaft with first and second pivot ends, said first and second pivot ends pivotably mounted within said first and second pinions, said lever disposed in said intermediate gap between said first and second pinions;

a block positionable between said lever and said body, said block having an embossing face moveable along a first axis; and at least one resilient member adjacent to said embossing face along a second axis spaced apart from said first axis, and disposed between said block and said body, wherein when said block is positioned between said lever and said body and when said lever mounted in said intermediate gap is pivoted about said pivot axis between a first position and a second position, said lever engages said axially moveable embossing face to emboss the sheet of material.

6. The embossing tool according to claim 5, wherein said at least one resilient member comprises first and second oppositely disposed springs adjacent to said embossing face, said first spring disposed along said second axis and said second spring disposed along a third axis, said third axis spaced apart from said first and second axes.

7. The embossing tool according to claim 5, wherein said fissure is substantially perpendicular to said first axis.

8. The embossing tool according to claim 5, wherein said embossing tool further comprises a housing which houses said block when positioned between said body and said lever.

9. The punch according to claim 8, wherein said lever extends through said housing.

10. The punch according to claim 8, wherein said housing provides an indication corresponding to a shape of said embossing face.

* * * * *